US006577839B2

(12) United States Patent
Samei

(10) Patent No.: US 6,577,839 B2
(45) Date of Patent: Jun. 10, 2003

(54) FIXING DEVICE THAT UNIFORMLY HEATS UNFIXED TONER IMAGES ALONG A FIXING NIP PORTION

(75) Inventor: Masahiro Samei, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/978,715

(22) Filed: Oct. 18, 2001

(65) Prior Publication Data

US 2002/0048472 A1 Apr. 25, 2002

(30) Foreign Application Priority Data

Oct. 19, 2000 (JP) ..... 2000-319028

(51) Int. Cl.[7] ..... G03G 15/20; H05B 6/36
(52) U.S. Cl. ..... 399/328; 219/672; 399/336
(58) Field of Search ..... 399/328, 329, 399/330, 336; 219/216, 672, 676

(56) References Cited

U.S. PATENT DOCUMENTS

| | | | | |
|---|---|---|---|---|
| 4,570,044 A | * | 2/1986 | Kobayashi et al. | 399/338 X |
| 5,752,148 A | * | 5/1998 | Yoneda et al. | 399/329 |
| 6,029,040 A | * | 2/2000 | Yamada et al. | 399/325 |
| 6,049,691 A | * | 4/2000 | Abe et al. | 399/330 |
| 6,337,969 B1 | * | 1/2002 | Takagi et al. | 399/330 |
| 6,377,775 B1 | * | 4/2002 | Nakayama et al. | 399/328 |

FOREIGN PATENT DOCUMENTS

| | | |
|---|---|---|
| GB | 2357461 | 6/2001 |
| JP | 63313182 | 12/1988 |
| JP | 1263679 | 10/1989 |
| JP | 8286539 | 11/1996 |
| JP | 11297462 | 10/1999 |
| JP | 2000-187406 | * 7/2000 |
| JP | 2001-188430 | * 7/2001 |

* cited by examiner

*Primary Examiner*—Fred L. Braun
(74) *Attorney, Agent, or Firm*—Stevens, Davis, Miller & Mosher, LLP

(57) ABSTRACT

A fixing device includes a fixing nip portion that conveys a recording material. As the recording material is conveyed, the fixing nip portion melts and fixes unfixed toner images on the recording material. The fixing device includes a first rotating element having a roller shape, an induction heating device, and a pressing member. The induction heating device has an exciting coil wound along the outer or inner peripheral surface of the first rotating element that heats the first rotating element by electromagnetic induction. The exciting coil has a clearance which changes in a direction of an axis of rotation of the heating roller to thereby vary the magnetic field intensity in the exciting coil. The pressing member is pressed into contact with the first rotating element, or a second rotating element heated by the first rotating element, and is rotated in the forward direction to form the fixing nip portion.

11 Claims, 9 Drawing Sheets

FIXING DEVICE THAT UNIFORMLY HEATS UNFIXED TONER IMAGES ALONG A FIXING NIP PORTION

BACKGROUND OF THE INVENTION

The present invention relates to a fixing device used for an electrostatic recording type image forming apparatus such as a copying machine, a facsimile, and a printer. More particularly, it relates to a fixing device of an electromagnetic induction heating system.

Regarding image forming apparatuses such as printers, copying machines, and facsimiles, the demand of the market for energy saving and high speed has increased in recent years. To achieve the demanded performance, it is important that the thermal efficiency of a fixing device used for the image forming apparatus should be improved.

As the fixing device for fixing unfixed toner images, which are formed by a transfer (indirect) system or a direct system using appropriate image forming process means such as electronic photograph recording, electrostatic recording, and magnetic recording, on a recording material such as a recording material sheet, a printing paper, a photosensitive paper, and an electrostatic recording paper, a fixing device of a heat roller system, a film heating system, an electromagnetic induction heating system, or the like has been used widely.

The fixing device of a heat roller system has a heat source such as a tungsten halogen lamp therein, and is basically configured by paired rotating rollers consisting of a fixing roller whose temperature is controlled so as to be a predetermined value and a pressure roller pressed into contact with the fixing roller. A recording material is introduced to the contact portion, what we call a fixing nip portion, of the paired rotating rollers and is conveyed while being held by the fixing nip portion. Unfixed toner images are melted by heat and pressure supplied from the fixing roller and the pressure roller, respectively, to be fixed on the recording material.

Also, the fixing device of a film heating system has been proposed in, for example, JP-A-63-313182 and JP-A-1-263679 specifications or the like.

For this device, a recording material is brought into close contact with a heating element fixedly supported by a support member via a thin fixing film having heat resistance, and the heat of the heating element is supplied to the recording material via the film while the fixing film is slidingly moved with respect to the heating element. In this fixing device, a ceramic heater basically constructed by a ceramic board formed of alumina ($Al_2O_3$), aluminum nitride (AlN), or the like having characteristics such as heat resistance, insulating properties, and high thermal conductivity, and a resistance layer, which generates heat by means of carried current, provided on the board can be used as the heating element, and a thin fixing film with low heat capacity can be used. Therefore, for this fixing device, the efficiency of heat transfer is high, the warm-up time can be shortened, and quick start and energy saving can be achieved as compared with the fixing device of a heat roller system.

As the fixing device of an electromagnetic induction heating system, JP-A-11-297462 specification has disclosed a technical idea in which an eddy current is generated in a conductive layer of a fixing roller by an alternating magnetic field to produce Joule's heat, and the fixing roller is heated by electromagnetic induction by using this Joule's heat.

The following is a description of the construction of a fixing device of an electromagnetic induction heating system. FIG. 10 is a schematic view of a conventional fixing device of an electromagnetic induction heating system.

The fixing device shown in FIG. 10 includes a fixing roller 21, an exciting coil 22 disposed along the outer peripheral surface of the fixing roller 21, a magnetic element 23 disposed on the outside of the exciting coil 22 so as to cover the exciting coil 22, a pressure roller 24 disposed so as to be pressed into contact with the fixing roller 21, and a temperature sensor 25 for detecting the temperature of the surface of the fixing roller 21.

For the fixing roller 21, a mold release layer formed of, for example, PTFE or PFA with heat resistance, which has a thickness of about 10 to 50 $\mu$m, is provided on the surface of a cylinder formed of iron with an outer diameter of 40 mm and a thickness of 0.7 mm.

The pressure roller 24 with an outside diameter of 30 mm is provided with an elastic member such as silicone rubber at the outer periphery of an iron-made core metal, like the fixing roller 21. To enhance the mold release characteristics, a layer formed of, for example, PTFE or PFA with heat resistance, which has a thickness of about 10 to 50 $\mu$m, is further provided on the surface of the elastic member.

The fixing roller 21 and the pressure roller 24 are rotatably supported on the housing side of the device, and only the fixing roller 21 is driven. The pressure roller 24 is pressed into contact with the surface of the fixing roller 21, and is rotated in a slave manner by a frictional force at a fixing nip portion N. The pressure roller 24 is pressed in the direction of the axis of rotation of the fixing roller 21 by pressing means (not shown) using a spring or the like.

The exciting coil 22 is disposed along an outer peripheral surface of the fixing roller 21, and is covered with the magnetic element 23. The magnetic element 23 is made of a material with high magnetic permeability and low residual magnetic flux density, such as ferrite and permalloy.

An alternating current of 10 to 100 MHz is applied to the exciting coil 22, and a magnetic field induced by this alternating current causes an eddy current to flow in the conductive layer of the fixing roller 21 to produce Joule's heat.

The temperature sensor 25 is disposed so as to be in contact with the surface of the fixing roller 21. And, the electric power supplied to the exciting coil 22 is increased or decreased based on the detection signal sent from the temperature sensor 25, by which the temperature of the surface of the fixing roller 21 is automatically controlled so as to be a predetermined fixed temperature.

A recording material 26, which is conveyed while carrying unfixed toner images T, is disposed at a position guided to the nip portion N between the fixing roller 21 and the pressure roller 24 by a conveying guide (not shown).

Thus, the fixing roller 21 is rotationally driven by driving means (not shown), an alternating current is applied to the exciting coil 22 and is introduced to the fixing nip portion N, and the fixing nip portion N is heated to the predetermined temperature. In this state, the recording material 26, which carries unfixed toner images T, is introduced to the fixing nip portion N by being guided by the conveying guide (not shown), and is conveyed along with the rotation of the fixing roller 21, by which the toner images T are melted and fixed on the recording material 26 by the heat of the fixing roller 21 and the nip pressure.

As described above, in the fixing device of an electromagnetic induction heating system, the fixing roller 21 can be heated with high heat transfer by utilizing the eddy current generated by electromagnetic induction. Therefore, this fixing device offers advantages that the warm-up time can be shortened, and quick start and energy saving can be achieved as compared with the fixing device of a film heating system.

Also, JP-A-8-286539 specification has disclosed a configuration in which electromagnetic induction heating means in which an exciting coil is wound along a core material in the direction of the axis of rotation of a rotating heat generating member is provided on the inside of the rotating heat generating member having a conductive layer consisting of a ferromagnetic metallic film etc. formed of nickel, iron, ferromagnetic SUS, nickel-cobalt alloy, or the like.

In the fixing device of an electromagnetic induction heating system disclosed in JP-A-11-297462 specification, although the fixing roller with relatively low heat capacity is used, the heat dissipating area is larger in the end portion than in the central portion in the direction of the axis of rotation of the fixing roller, so that the amount of dissipated heat increases in the end portion of the fixing roller. Therefore, uniform temperature distribution cannot be obtained in the fixing nip portion, and the temperature decreases in the end portion of the fixing roller, so that sufficient thermal energy cannot be supplied to the recording material and the unfixed toner images formed on the recording material in the end portion, which presents a problem that toner is peeled off by the fixing roller, that is, what we call an offset phenomenon takes place.

Also, the fixing device of an electromagnetic induction heating system disclosed in JP-A-8-286539 specification is a system in which a film with very low heat capacity is used as the rotating heat generating member, and the conductive layer of the film is heated by electromagnetic induction heating. Like the above-described fixing device using the fixing roller, the temperature of the end portion decreases as compared with the central portion in the direction of the axis of rotation of the film, so that uniform temperature distribution cannot be obtained in the fixing nip portion, and sufficient thermal energy cannot be supplied in the end portion, which presents a problem that an offset phenomenon takes place.

Further, since this fixing device is configured so that electromagnetic induction heating means such as an exciting coil is provided on the inside of the rotating heat generating member, uniform and efficient heat dissipation of the electromagnetic induction heating means is difficult to do, which presents a problem that the coil itself is heated by self heat generation due to a copper loss of exciting coil.

SUMMARY OF THE INVENTION

Accordingly, an object of the present invention is to provide a fixing device of an electromagnetic induction heating system capable of uniforming the temperature distribution in a fixing nip portion in the direction of the axis of rotation of a rotating element and decreasing a rise in temperature of an exciting coil.

To solve the above problems, the present invention provides a fixing device in which a recording material is conveyed by being held by a fixing nip portion, and unfixed toner images on the recording material are melted and fixed, including: a first rotating element of a roller shape; induction heating means, which is provided with an exciting coil wound along the outer peripheral surface or the inner peripheral surface of the first rotating element and having a clearance changing in the direction of the axis of rotation of the first rotating element, for heating the first rotating element by electromagnetic induction; and a pressing member which is pressed into contact with the first rotating element or a second rotating element heated by the first rotating element and is rotated in the forward direction to form the fixing nip portion.

By this configuration, since the clearance of the exciting coil increases from the central portion toward the end portion in the direction of the axis of rotation of the first rotating element, the intensity of magnetic field in the end portion is made higher than in the central portion, so that the heating value increases in the end portion, and thus the temperature distribution in the fixing nip portion can be made uniform.

Also, the present invention provides a fixing device in which a recording material is conveyed by being held by a fixing nip portion, and unfixed toner images on the recording material are melted and fixed, including: a first rotating element of a roller shape; induction heating means, which is provided with an exciting coil wound along the outer peripheral surface or the inner peripheral surface of the first rotating element and having a winding length changing in the direction of the axis of rotation of the first rotating element, for heating the first rotating element by electromagnetic induction; and a pressing member which is pressed into contact with the first rotating element or a second rotating element heated by the first rotating element and is rotated in the forward direction to form the fixing nip portion.

By this configuration, since the winding length of exciting coil increases from the central portion toward the end portion in the direction of the axis of rotation of the first rotating element, the amount of eddy current generated on the surface of the rotating element in the end portion is made larger than the amount of eddy current generated in the central portion, so that the heating value increases in the end portion, and thus the temperature distribution in the fixing nip portion can be made uniform.

Further, the present invention provides a fixing device in which a recording material is conveyed by being held by a fixing nip portion, and unfixed toner images on the recording material are melted and fixed, including: a first rotating element of a roller shape; induction heating means, which is provided with an exciting coil wound along the outer peripheral surface or the inner peripheral surface of the first rotating element and having a cross-sectional area of core material changing in the direction perpendicular to the axis of rotation of the first rotating element, for heating the first rotating element by electromagnetic induction; and a pressing member which is pressed into contact with the first rotating element or a second rotating element heated by the first rotating element and is rotated in the forward direction to form the fixing nip portion.

By this configuration, since the cross-sectional area of core material of the exciting coil increases from the central portion toward the end portion in the direction perpendicular to the axis of rotation of the first rotating element, the absorption efficiency of magnetic field in the end portion is made higher than that in the central portion, so that the heating value increases in the end portion, and thus the temperature distribution in the fixing nip portion can be made uniform.

Figure 1:
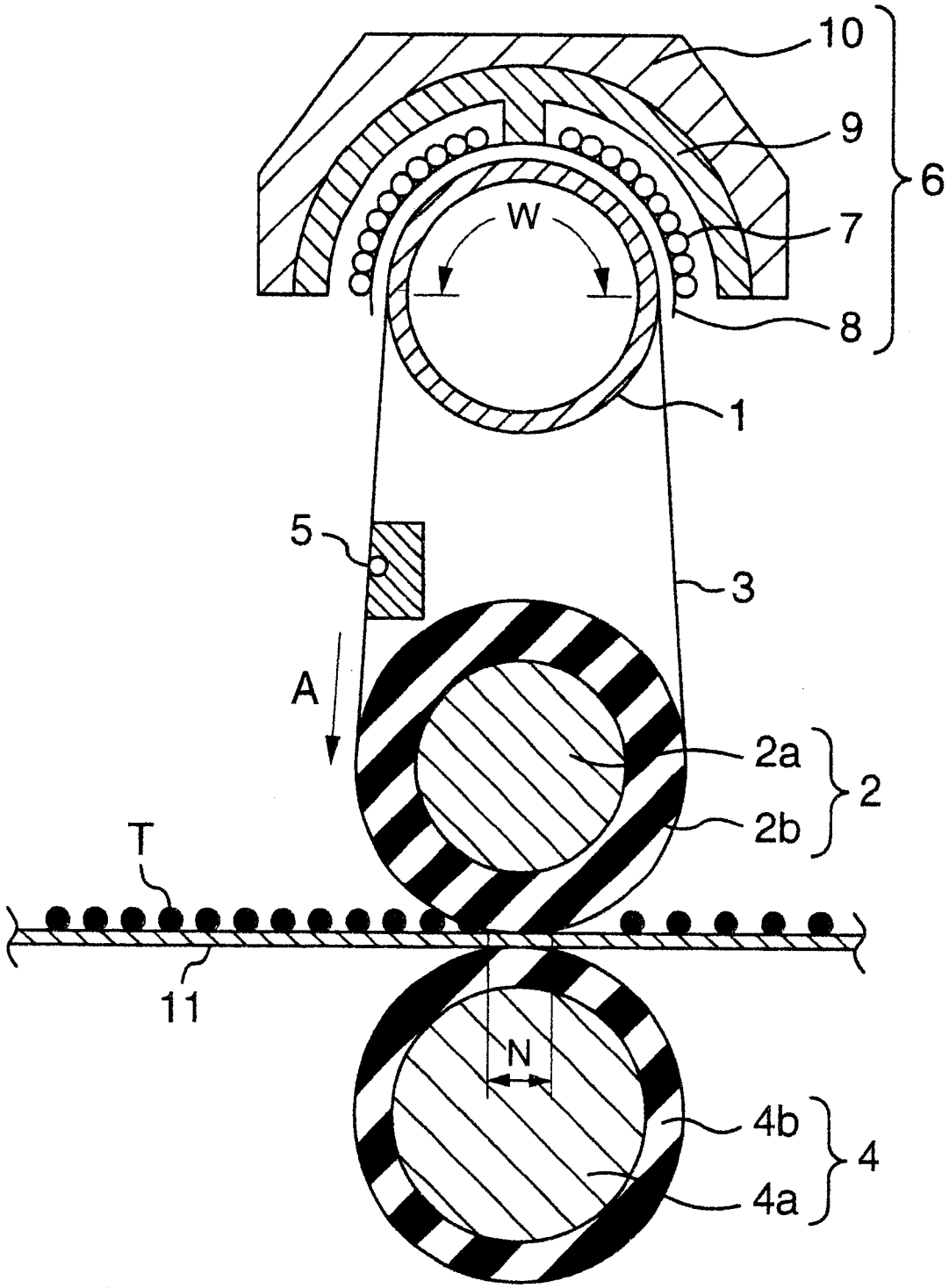
FIG. 1 is an explanatory view of a fixing device in accordance with one embodiment of the present invention.
Figure 2A:
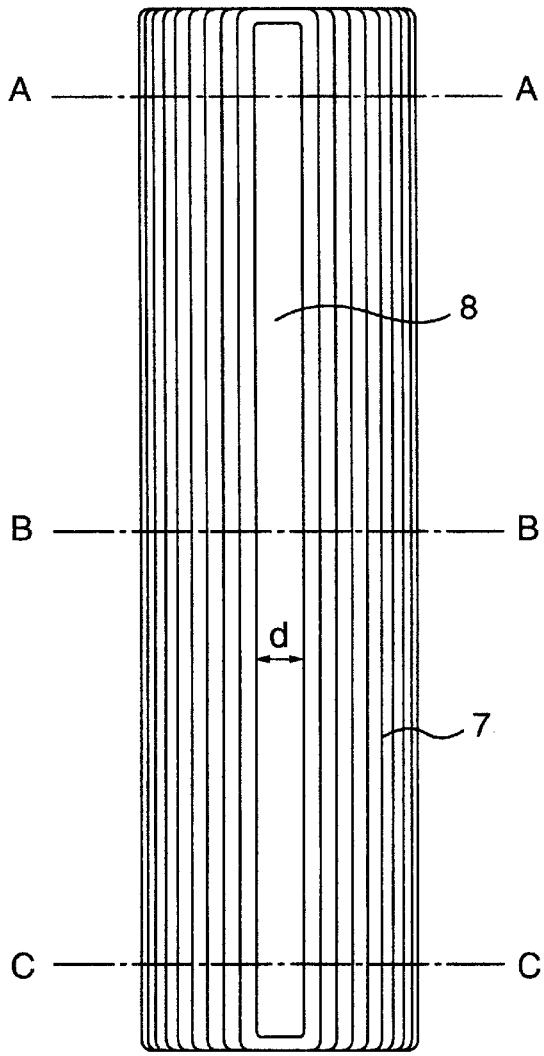
FIG. 2A is a plan view of an exciting coil of induction heating means in the fixing device shown in FIG. 1, and FIG.
Figure 3A:
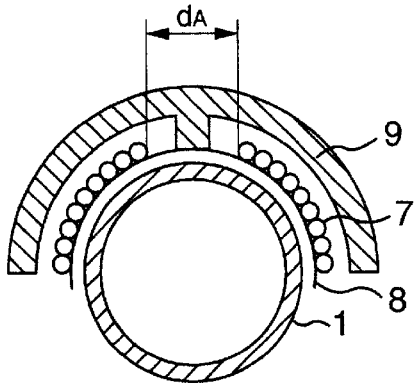
Figure 3B:
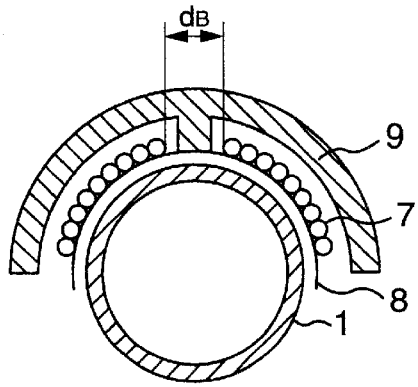
Figure 3C:
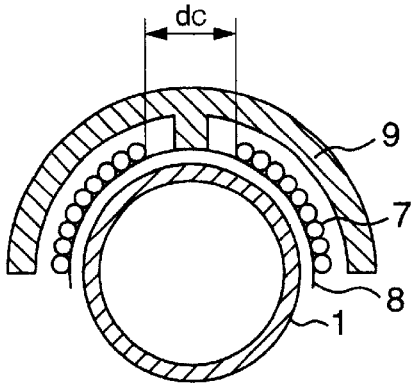
Figure 3D:
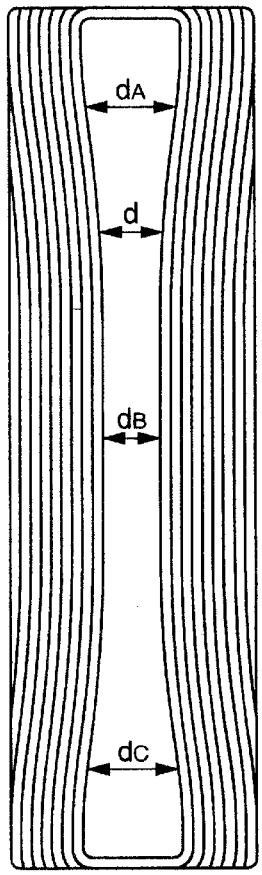
Figure 4A:
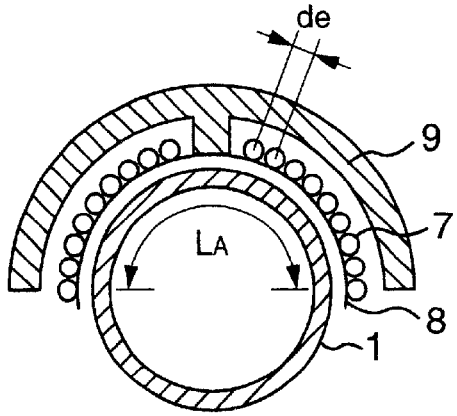
Figure 4B:
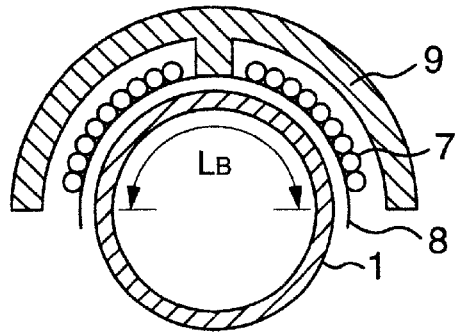
Figure 4C:
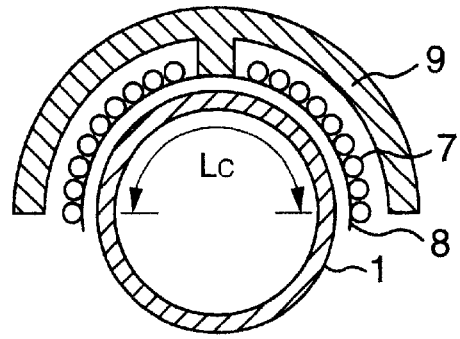
Figure 5:
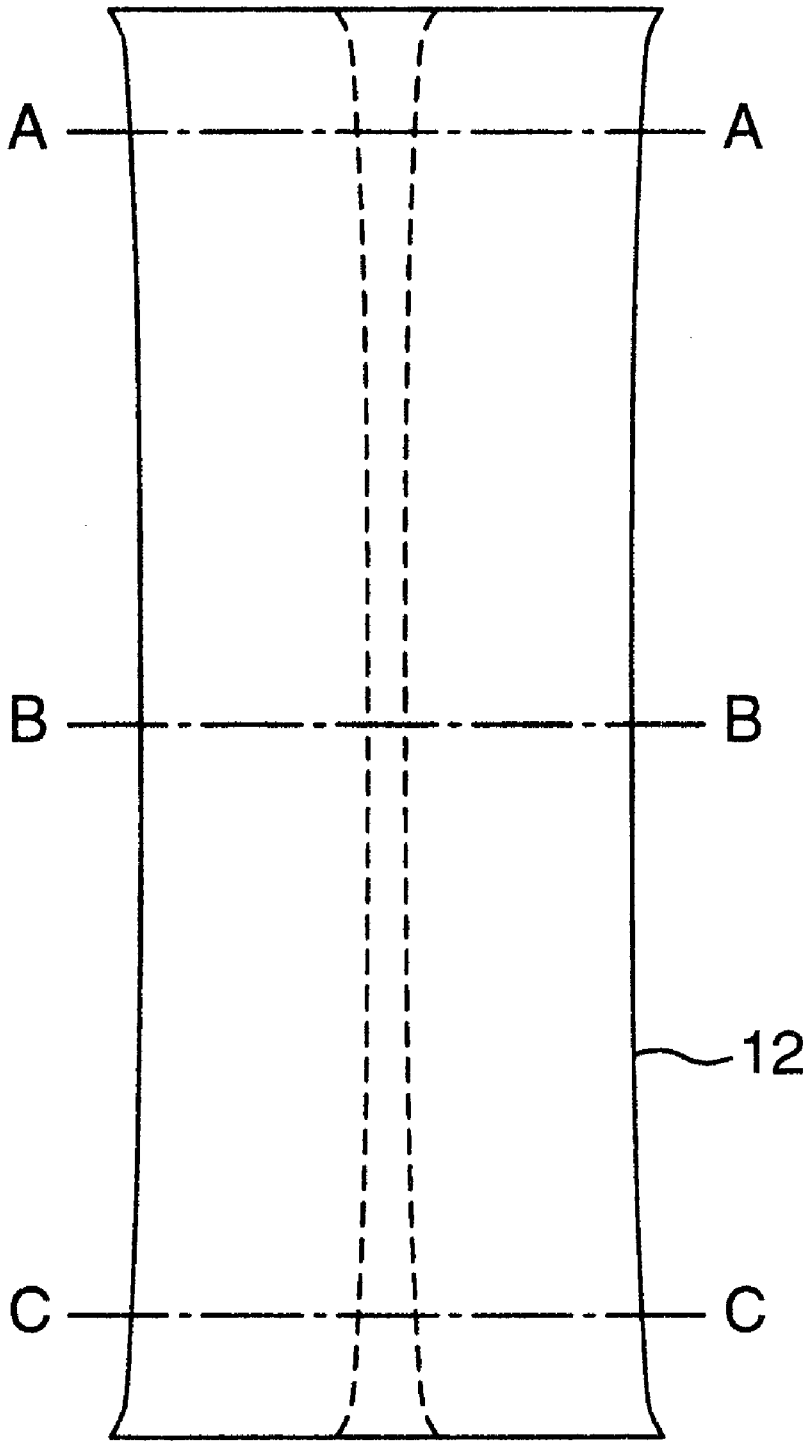
Figure 6A:
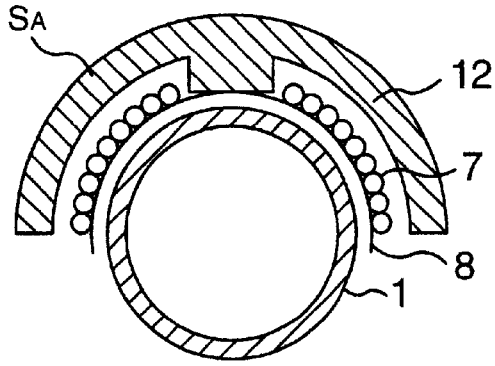
Figure 6B:
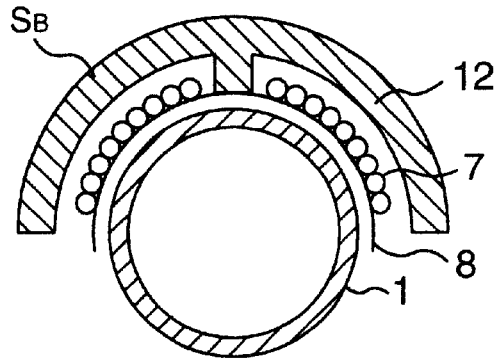
Figure 6C:
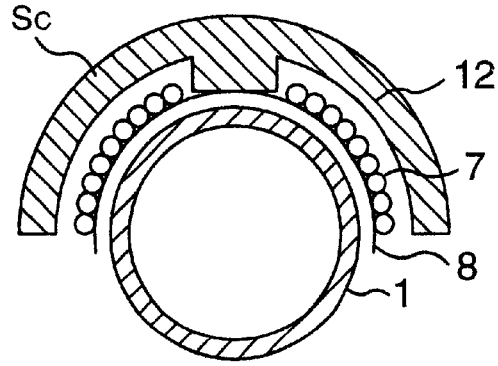
Figure 7A:
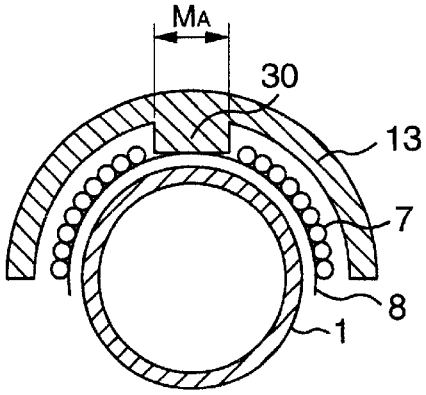
Figure 7B:
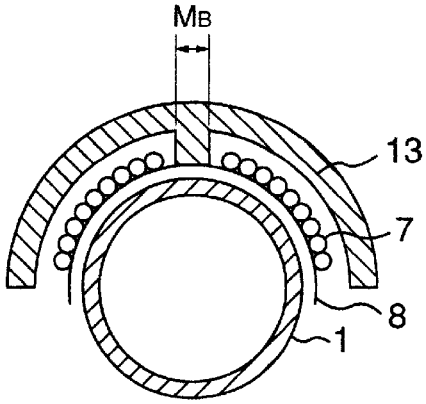
Figure 7C:
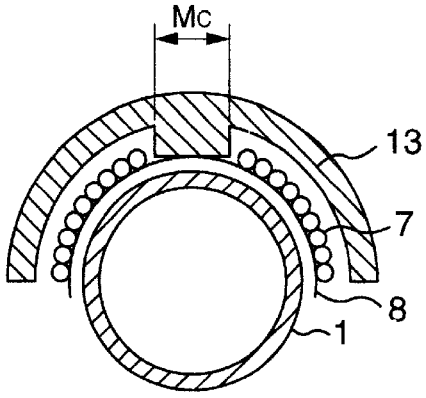
Figure 8:
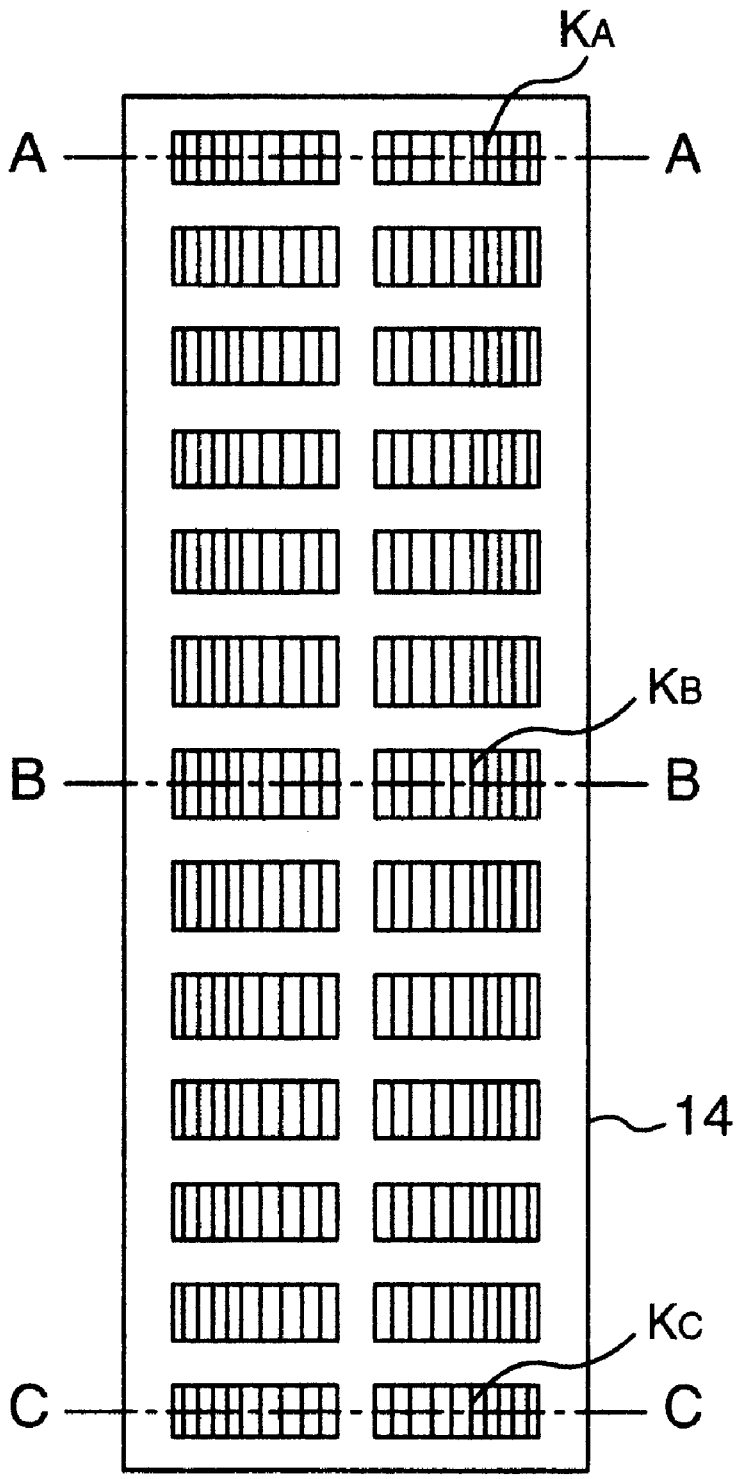
Figure 9:
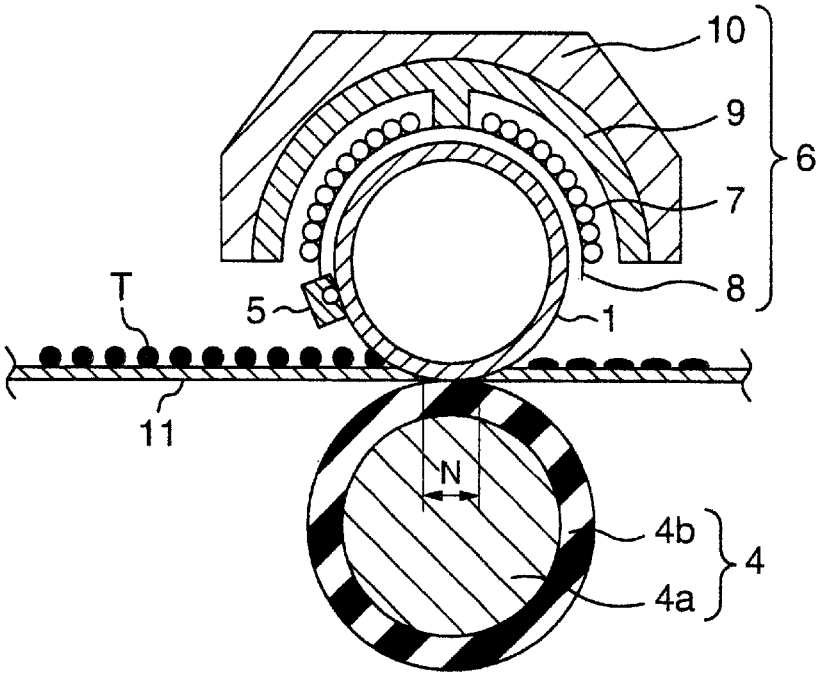
Figure 10:
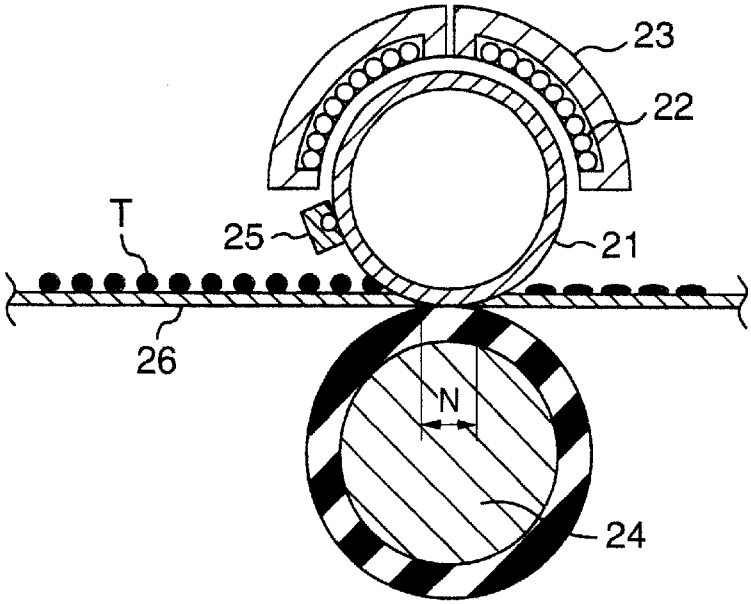
FIG. 10 RELATED ART

2B is a sectional view of an exciting coil of induction heating means in the fixing device shown in FIG. 1;

FIG. 3A is a sectional view taken along a line A—A of FIG. 2A, FIG. 3B is a sectional view taken along a line B—B of FIG. 2A, FIG. 3C is a sectional view taken along a line C—C of FIG. 2A, and FIG. 3D is a sectional view of a heating roller portion used for a fixing device of an image forming apparatus in accordance with the present invention;

FIG. 4A is a sectional view taken along the line A—A of FIG. 2A, FIG. 4B is a sectional view taken along the line B—B of FIG. 2A, and FIG. 4C is a sectional view taken along the line C—C of FIG. 2A;

FIG. 5 is a plan view of another exciting coil core of induction heating means in the fixing device shown in FIG. 1;

FIG. 6A is a sectional view taken along the line A—A of FIG. 5, FIG. 6B is a sectional view taken along the line B—B of FIG. 5, and FIG. 6C is a sectional view taken along the line C—C of FIG. 5;

FIG. 7A is a sectional view taken along the line A—A of FIG. 5 in a case where still another exciting coil core of induction heating means in the fixing device shown in FIG. 1 is used, FIG. 7B is a sectional view taken along the line B—B of FIG. 5 in this case, and FIG. 7C is a sectional view taken along the line C—C of FIG. 5 in this case;

FIG. 8 is a front view of still another exciting coil core of induction heating means in the fixing device shown in FIG. 1;

FIG. 9 is a sectional view showing an other configuration of a fixing device in accordance with another embodiment of the present invention; and FIG. 10 is a schematic view of a conventional fixing device of an electromagnetic induction heating system.

DESCRIPTION OF THE PREFERRED EMBODIMENTS

The present invention as set forth in claim 1 provides a fixing device in which a recording material is conveyed by being held by a fixing nip portion, and unfixed toner images on the recording material are melted and fixed, including: a first rotating element of a roller shape; induction heating means, which is provided with an exciting coil wound along the outer peripheral surface or the inner peripheral surface of the first rotating element and having a clearance changing in the direction of the axis of rotation of the first rotating element, for heating the first rotating element by electromagnetic induction; and a pressing member which is pressed into contact with the first rotating element or a second rotating element heated by the first rotating element and is rotated in the forward direction to form the fixing nip portion. The invention of this mode has an operation such that the intensity of magnetic field generated from the exciting coil can be controlled in the direction of the axis of rotation of the first rotating element.

The present invention as set forth in claim 2 relates to a fixing device as set forth in claim 1, in which at least a part of clearance of the exciting coil increases from the central portion toward the end portion of the first rotating element. The invention of this mode has an operation such that the intensity of magnetic field in the end portion is higher than that in the central portion, and thus the heating value in the end portion increases, so that the temperature distribution in the fixing nip portion can be made uniform.

The present invention as set forth in claim 3 provides a fixing device in which a recording material is conveyed by being held by a fixing nip portion, and unfixed toner images on the recording material are melted and fixed, including: a first rotating element of a roller shape; induction heating means, which is provided with an exciting coil wound along the outer peripheral surface or the inner peripheral surface of the first rotating element and having a winding length changing in the direction of the axis of rotation of the first rotating element, for heating the first rotating element by electromagnetic induction; and a pressing member which is pressed into contact with the first rotating element or a second rotating element heated by the first rotating element and is rotated in the forward direction to form the fixing nip portion. The invention of this mode has an operation such that the quantity of eddy current generated on the surface of the rotating element can be controlled in the direction of the axis of rotation of the first rotating element.

The present invention as set forth in claim 4 relates to a fixing device as set forth in claim 3, in which at least a part of winding length of the exciting coil increases from the central portion toward the end portion of the first rotating element. The invention of this mode has an operation such that the quantity of eddy current generated on the surface of rotating element in the end portion is larger than the quantity of eddy current generated in the central portion, and thus the heating value in the end portion increases, so that the temperature distribution in the fixing nip portion can be made uniform.

The present invention as set forth in claim 5 provides a fixing device in which a recording material is conveyed by being held by a fixing nip portion, and unfixed toner images on the recording material are melted and fixed, including: a first rotating element of a roller shape; induction heating means, which is provided with an exciting coil wound along the outer peripheral surface or the inner peripheral surface of the first rotating element and having a cross-sectional area of core material changing in the direction perpendicular to the axis of rotation of the first rotating element, for heating the first rotating element by electromagnetic induction; and a pressing member which is pressed into contact with the first rotating element or a second rotating element heated by the first rotating element and is rotated in the forward direction to form the fixing nip portion. The invention of this mode has an operation such that the absorption efficiency of magnetic field absorbed by the core of exciting coil can be controlled in the direction of the axis of rotation of the first rotating element.

The present invention as set forth in claim 6 relates to a fixing device as set forth in claim 5, in which at least a part of cross-sectional area of a core material of the exciting coil increases from the central portion toward the end portion of the first rotating element. The invention of this mode has an operation such that the absorption efficiency of magnetic field in the end portion is higher than that in the central portion, and thus the heating value in the end portion increases, so that the temperature distribution in the fixing nip portion can be made uniform.

The present invention as set forth in claim 7 relates to a fixing device as set forth in any one of claims 1 to 6, in which a core material of the exciting coil is formed of a resin member in which magnetic powder is mixed. The invention of this mode has an operation such that the core is made small, so that the parts cost can be reduced.

The present invention as set forth in claim 8 relates to a fixing device as set forth in any one of claims 1 to 7, in which a core material of the exciting coil consists of an integrally molded core. The invention of this mode has an operation such that the core can be fabricated into a very fine shape with high flexibility, and also the manpower for assembling the core can be reduced.

The present invention as set forth in claim 9 relates to a fixing device as set forth in claim 8, in which a core material of the exciting coil consists of a core formed with a plurality of holes. The invention of this mode has an operation such that the heat generated in the exciting coil can be released through these holes.

The present invention as set forth in claim 10 relates to a fixing device as set forth in claim 8 or claim 9, in which the hole area of core material of the exciting coil changes in the direction perpendicular to the axis of rotation of the first rotating element. The invention of this mode has an operation such that the intensity of magnetic field generated by the core of the exciting coil can be controlled in the direction of the axis of rotation of the first rotating element.

The present invention as set forth in claim 11 relates to a fixing device as set forth in any one of claims 8 to 10, in which at least a part of hole area of the core material of the exciting coil decreases from the central portion toward the end portion of the first rotating element. The invention of this mode has an operation such that the intensity of magnetic field in the end portion is higher than that in the central portion, and thus the heating value in the end portion increases, so that the temperature distribution in the fixing nip portion can be made uniform.

First Embodiment

Embodiments of the present invention will be described below with reference to FIGS. 1 to 9. In these drawings, the same reference numerals are applied to the same elements, and the duplicated explanation is omitted.

FIG. 1 is an explanatory view of a fixing device in accordance with one embodiment of the present invention. The fixing device shown in FIG. 1, which is a fixing device of an electromagnetic induction heating device used for an image forming apparatus, includes a heating roller (first rotating element) 1 heated along the outer peripheral surface thereof by electromagnetic induction generated by an electric current carried in an exciting coil 7 of induction heating means 6, a fixing roller 2 disposed in parallel with the heating roller (first rotating element) 1 in the axial direction of the heating roller 1, an endless band-shaped heat resisting belt (second rotating element) 3 which is set around the heating roller 1 and the fixing roller 2 and is run in the direction indicated by the arrow A by the rotation of the fixing roller 2 while being heated by the heating roller 1, and a pressure roller (pressing member) 4 which comes into contact with the heat resisting belt 3 to form a nip portion so as to be pressed into contact with the fixing roller 2, and is rotated in the forward direction in a slave manner with respect to the heat resisting belt 3.

The heating roller 1 consists of a hollow cylindrical ferromagnetic metallic member formed of, for example, Fe, Ni, SUS, etc., having, for example, an outside diameter of 20 mm and a thickness of 0.3 mm. The heating roller 1 is constructed so that the heat capacity is low and thus the temperature rises rapidly.

The fixing roller 2 includes a core metal 2*a* formed of a metal such as SUS and an elastic member 2*b*, formed of silicone rubber of a solid form or a foaming form having heat resistance, for covering the core metal 2*a*. In order to form a contact portion with a predetermined width between the fixing roller 2 and the pressure roller 4 by the pressing force of the pressure roller 4, the fixing roller 2 has an outside diameter of about 30 mm, which is larger than that of the heating roller 1. The thickness of the elastic member 2*b* is about 3 to 8 mm, and the hardness thereof is about 15 to 50° (Asker C)

By the above-described configuration, the heat capacity of the heating roller 1 is made lower than that of the fixing roller 2, so that the heating roller 1 is heated rapidly, and thus the warm-up time is shortened.

The heat resisting belt 3 set between the heating roller 1 and the fixing roller 2 is heated in a contact portion W in which the heat resisting belt 3 is in contact with the heating roller 1 heated by the induction heating means 6 disposed on the outer peripheral surface of the heating roller 1. The inside surface of the heat resisting belt 3 is heated continuously by the rotation of the heat resisting belt 3 along with the rotation of the fixing roller 2 effected by driving means (not shown).

The heat resisting belt 3 is a composite layer belt consisting of a base material layer having heat resistance, formed of fluorocarbon resin, polyimide resin, polyamide resin, polyamide-imide resin, PEEK resin, PES resin, PPS resin, etc. and a mold release layer consisting of an elastic member formed of silicone rubber, fluororubber, etc. provided so as to cover the surface of the base material layer.

According to this configuration, since the base material layer is formed of a resin member having high heat resistance, the heat resisting belt 3 is likely to come into close contact with the heating roller 2 according to the curvature of the heating roller 1, so that the heat retained by the heating roller 1 is efficiently transmitted to the belt 3.

In this case, the thickness of the resin layer is preferably about 20 to 150 $\mu$m, especially about 75 $\mu$m. If the thickness of the resin layer is smaller than 20 $\mu$m, the mechanical strength against zigzag motion at the time of running of belt cannot be obtained. On the other hand, if the thickness of the resin layer is larger than 150 $\mu$m, the heat shielding effect increases and thus the efficiency of heat transfer from the heating roller 1 to the mold release layer of the heat resisting belt 3 decreases, so that the fixing performance decreases.

On the other hand, the thickness of the mold release layer is preferably about 100 to 300 $\mu$m, especially about 200 $\mu$m. By this configuration, toner images T formed on a recording material 11 are enveloped fully by the surface layer portion of the heat resisting belt 3, so that the toner images T can be heated and melted uniformly.

If the thickness of the mold release layer is smaller than 100 $\mu$m, the heat capacity of the heat resisting belt 3 is low, so that the temperature of belt surface decreases rapidly in the toner fixing process. Therefore, the fixing performance cannot be ensured fully. On the other hand, if the thickness of the mold release layer is larger than 300 $\mu$m, the heat capacity of the heat resisting belt 3 is high, so that the time taken for warm-up increases, and also the temperature of belt surface decreases in the toner fixing process. Therefore, the coagulation effect of melted toner at the outlet of the fixing portion cannot be obtained, and a phenomenon that mold release characteristics decrease and thus toner sticks to the belt, what we call a hot offset, takes place.

As the base material layer of the heat resisting belt 3, a ferromagnetic metallic member formed of Ni, Cu, Cr, SUS, etc. may be used in place of the heat resisting resin member formed of fluorocarbon resin, polyimide resin, polyamide resin, polyamide-imide resin, PEEK resin, PES resin, PPS resin, etc.

In this case, even if a gap is produced between the heat resisting belt 3 and the heating roller 1, for example, by the entrance of foreign matters between them caused by any reason, the heat resisting belt 3 itself generates heat by the heat generated by electromagnetic induction of the base material layer of the heat resisting belt 3, so that the nonuniformity of temperature is less and thus the reliability increases.

The thickness of the metallic member is preferably about 20 to 50 $\mu$m, especially about 30 $\mu$m.

If the thickness of the metallic member is larger than 50 $\mu$m, the strain stress generated at the time of running of belt is high, so that a crack develops due to a shearing force and the mechanical strength decreases extremely. On the other hand, if the thickness of the base material layer is smaller than 20 $\mu$m, a failure such as a crack occurs due to a thrust load applied to the belt edge by the zigzag motion at the time of running of belt.

The pressure roller 4 includes a core metal 4*a* consisting of a metallic cylindrical member with high thermal conductivity, formed of, for example, SUS, Al, etc., and an elastic member 4*b* with high heat resistance and mold release characteristics, provided on the surface of the core metal 4*a*.

The pressure roller 4 is in contact with the heat resisting belt 3 and presses the fixing roller 2 to form a fixing nip portion N. In this embodiment, in order to increase the toner peeling action at the outlet of the fixing nip portion N, the pressure roller 4 is configured so that although the outside diameter thereof is about 30 mm, which is the same as that of the fixing roller 2, the thickness is about 2 to 5 mm, which is smaller than that of the fixing roller 2, and the hardness is about 20 to 60° (Asker C), which is lower than that of the fixing roller 2.

Figure 2B:
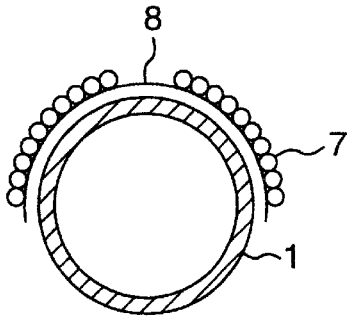

FIG. 2A is a plan view of an exciting coil of induction heating means in the fixing device shown in FIG. 1, and FIG. 2B is a sectional view of an exciting coil of induction heating means in the fixing device shown in FIG. 1. As shown in FIGS. 2A and 2B, the induction heating means 6, shown in FIG. 1, for heating the heating roller 1 by electromagnetic induction has the exciting coil 7, which is magnetic field generating means, and a coil guide 8 around which the exciting coil 7 is wound. The coil guide 8 has a semicircular arch shape disposed close to the outer peripheral surface of the heating roller 1 as viewed in the axial direction of the heating roller 1. The exciting coil 7 consists of a long one exciting coil wire wound alternately along the coil guide 8 in the direction of the axis of rotation of the heating roller 1. The winding length of the exciting coil 7 corresponds to the region in which the heat resisting belt 3 is in contact with the heating roller 1 in the direction of the axis of rotation of the heating roller 1. The induction heating means 6 may be disposed along the inner peripheral surface of the heating roller 1.

According to this configuration, the region of the heating roller 1 heated by electromagnetic induction by using the induction heating means 6 becomes largest, and the time for which the heat resisting belt 3 is in contact with the surface of the heat generating heating roller 1 also becomes longest, so that the efficiency of heat transfer increases.

The exciting coil 7 is connected to a driving power source (not shown) in which the oscillation circuit has a variable frequency.

On the outside of the exciting coil 7, an exciting coil core 9 consisting of a semicircular arch shaped member is fixed to an exciting coil core support member 10 and is disposed close to the exciting coil 7. As the exciting coil core 9, a ferromagnetic element formed of ferrite, permalloy, etc. may be used. In this embodiment, an integrally molded product produced by mixing ferromagnetic powder such as iron, nickel and ferromagnetic SUS with a heat resisting resin such as PEEK resin, PES resin, and PPS resin is used.

According to this configuration, the exciting coil core 9 is made small in size, so that the material cost can be reduced, and also the manpower for assembling the core can be decreased significantly.

Also, the core can be fabricated into a very fine shape with high flexibility, so that the temperature distribution in the direction of the axis of rotation of the heating roller 1 can be made uniform.

Further, by forming a plurality of holes in the exciting coil core 9 and the exciting coil core support member 10, the heat generated by a copper loss of the exciting coil 7 can be dissipated to the outside of the induction heating mean 6.

The exciting coil 7 is supplied with a high-frequency alternating current of 10 kHz to 1 MHz, preferably 20 kHz to 800 kHz, from the driving power source, by which an alternating magnetic field is produced. In the contact region W in which the heat resisting belt 3 is in contact with the heating roller 1 and the nearby portion thereof, this alternating magnetic field acts on the heating roller 1, so that an eddy current flows in the heating roller 1 in the direction such as to hinder a change in the magnetic field.

This eddy current generates Joule's heat according to the resistance of the heating roller 1, and the heating roller 1 is heated by electromagnetic induction heating mainly in the contact region in which the heat resisting belt 3 is in contact with the heating roller 1 and the nearby portion thereof.

The heat resisting belt 3 is heated by the heat generating heating roller 1, and the temperature of the inside surface of belt is detected by temperature detecting means 5 consisting of a temperature-sensitive element with high thermal response, such as a thermistor, which is provided on the inlet side of the fixing nip portion N.

Since the temperature detecting means 5 does not damage the surface of the heat resisting belt 3, the fixing performance is ensured continuously, and also the temperature of the heat resisting belt 3 is detected just before the belt 3 enters the fixing nip portion N. The electric power supplied to the induction heating means 6 is controlled based on the signal sent on the basis of this temperature information, by which the temperature of the heat resisting belt 3 is kept steadily at, for example, 180° C.

When the toner images T formed on the recording material 11 in an image forming section (not shown) disposed on the upstream side of the fixing device in the manuscript conveying direction is introduced in the fixing nip portion N, the recording material 11 is sent into the fixing nip portion N in a state in which a difference between the surface temperature and the back temperature of the heat resisting belt 3 heated by the heating means 6 is small. Therefore, a phenomenon that the surface temperature of belt increases excessively as compared with the preset temperature, what we call overshoot, is restrained, and steady temperature control can be carried out.

Second Embodiment

FIGS. 3A to 3C are sectional views of the heating roller portion used for the fixing device of the image forming apparatus in accordance with the present invention. The amount of dissipated heat in the direction of the axis of rotation of the heating roller 1 increases from the central portion toward the end portion. This is because the heat dissipation area is larger in the end portion of the heating roller 1 than in the central portion thereof. Therefore, in order to obtain uniform temperature distribution in the fixing nip portion N, the amount of heat generated in the end portion of the heating roller 1 must be increased.

This embodiment is characterized by a configuration in which the width d of a clearance formed in the center of the exciting coil 7 increases from the central portion in the axial direction of the heating roller 1 toward the end portion in the axial direction thereof as shown in FIGS. 3A, 3B and 3C.

The amount of Joule's heat generated in the heating roller 1 by the magnetic field produced by the exciting coil 7 changes according to the width d of clearance formed in the center of the exciting coil 7.

When the width d is small, the magnetic fields interfere with each other between the alternately wound coils, so that the magnetic field acts in the direction such that the magnetic fields are weakened each other.

Therefore, the heating value increases as the width d increases.

FIG. 3D is a sectional view of the heating roller portion used for the fixing device of the image forming apparatus in accordance with the present invention.

In FIG. 3D, when a clearance of the exciting coil 7 in the central portion is taken as dB, and clearances of the exciting coil 7 in the end portions are taken as dA and dC, the clearances are set so as to have the relationship of dB<dA and dB<dC.

By doing this, the intensity of magnetic field between coils is made higher in the end portion than in the central portion, so that the heating value increases in the end portion, and thus the temperature distribution in the fixing nip portion can be made uniform.

Third Embodiment

FIGS. 4A, 4B and 4C are sectional views taken along lines A—A, B—B and C—C of FIG. 2A, respectively.

This embodiment of the present invention is configured so that as shown in FIGS. 4A, 4B and 4C, the winding length L of the exciting coil 7 in the circumferential direction of the heating roller 1 increases from the central portion toward the end portion in the direction of the axis of rotation of the heating roller 1.

Specifically, when the winding length of the exciting coil 7 in the central portion is taken as LB, and the winding lengths of the exciting coil 7 in the end portions are taken as LA and LC, the winding lengths are set so as to have the relationship of LB<LA and LB<LC.

By doing this, the amount of eddy current generated on the surface of the heating roller 1 in the end portion is made larger than the amount of eddy current generated in the central portion, so that the heating value increases in the end portion, and thus the temperature distribution in the fixing nip portion can be made uniform.

Fourth Embodiment

FIG. 5 is a top view of a coil core of the fixing device in accordance with the embodiment of the present invention, and FIGS. 6A to 6C are sectional views of a coil core of the fixing device in accordance with the embodiment of the present invention.

The embodiment of the present invention is configured so that as shown in FIG. 5, the cross-sectional area of an exciting coil core 12 obtained by cutting in a plane perpendicular to the direction of the axis of rotation of the heating roller 1 changes from the central portion toward the end portion in the direction of the axis of rotation of the heating roller 1.

As shown in FIGS. 6A, 6B and 6C, a cross-sectional area S of the exciting coil core 12 increases from the central portion toward the end portion in the direction of the axis of rotation of the heating roller 1.

Specifically, when the cross-sectional area of the exciting coil core 12 in the central portion is taken as SB, and the cross-sectional areas of the exciting coil core 12 in the end portions are taken as SA and SC, the cross-sectional areas are set so as to have the relationship of SB<SA and SB<SC.

By doing this, the absorption efficiency of magnetic field in the end portion is made higher than that in the central portion, so that the heating value increases in the end portion, and thus the temperature distribution in the fixing nip portion can be made uniform.

Fifth Embodiment

FIGS. 7A, 7B and 7C are sectional views of a coil core of the fixing device in accordance with the embodiment of the present invention.

As shown in FIGS. 7A, 7B and 7C, the configuration is such that a cross-sectional area M of a protrusion 30 of an exciting coil core 13 disposed between the alternately wound exciting coils 7, which is obtained by cutting in a plane perpendicular to the axis of rotation of the heating roller 1, increases from the central portion toward the end portion in the direction of the axis of rotation of the heating roller 1.

Specifically, when the cross-sectional area of the exciting coil core 13 in the central portion is taken as MB, and the cross-sectional areas of the exciting coil core 13 in the end portions are taken as MA and MC, the cross-sectional areas are set so as to have the relationship of MB<MA and MB<MC.

By doing this as well, as in the case where the exciting coil core 12 is used, the absorption efficiency of magnetic field in the end portion is made higher than that in the central portion, so that the heating value increases in the end portion, and thus the temperature distribution in the fixing nip portion can be made uniform.

Sixth Embodiment

FIG. 8 is a top view of a coil core of the fixing device in accordance with the embodiment of the present invention, in which a coil core 14 is provided with a plurality of holes K in the top surface thereof.

Another embodiment of the present invention is configured so that as shown in FIG. 8, the holes K are provided in the top surface of an exciting coil core 14 regularly, for example, at fixed intervals, and the area of the hole K decreases gradually from the central portion toward the end portion in the direction of the axis of rotation of the heating roller 1.

Specifically, when the area of the hole K of the exciting coil core 14 in the central portion is taken as KB, and the areas of the hole K of the exciting coil core 14 in the end portions are taken as KA and KC, the areas of hole K are set so as to have the relationship of KB<KA and KB<KC.

By doing this, the intensity of magnetic field in the end portion is made higher than that in the central portion, so that the heating value increases in the end portion, and thus the temperature distribution in the fixing nip portion can be made uniform.

Seventh Embodiment

FIG. 9 is a sectional view showing the configuration of a fixing device in accordance with another embodiment of the present invention.

In the above-described embodiments, examples in which the fixing belt is set between the heating roller and the fixing roller have been described. However, as shown in FIG. 9, the same effects can be achieved by the configuration in which the fixing device consists of the heating roller (first rotating element) 1 heated along the outer peripheral surface thereof by electromagnetic induction of the induction heating means 6 and a pressure roller (pressing member) 4 which is in contact with the heating roller 1 to form the nip portion and is rotated in the forward direction with respect to the heating roller 1. All fixing devices in the above-described embodiments can be replaced with this embodiment.

As described above, according to the present invention, since the clearance of the exciting coil increases from the central portion toward the end portion in the direction of the axis of rotation of the first rotating element, the amount of eddy current generated in the surface of rotating element in the end portion is larger than that in the central portion. Therefore, an effective effect that the heating value increases in the end portion and thus the temperature distribution in the fixing nip portion can be made uniform can be achieved.

Also, since the winding length of the exciting coil increases from the central portion toward the end portion in the direction of the axis of rotation of the first rotating element, the amount of eddy current generated in the surface of rotating element in the end portion is larger than that in the central portion. Therefore, an effective effect that the heating value increases in the end portion and thus the temperature distribution in the fixing nip portion can be made uniform can be achieved.

Further, since the cross-sectional area of core material of the exciting coil increases from the central portion toward the end portion in the direction perpendicular to the axis of rotation of the first rotating element, the absorption efficiency of magnetic field in the end portion is higher than that in the central portion. Therefore, an effective effect that the heating value increases in the end portion and thus the temperature distribution in the fixing nip portion can be made uniform can be achieved.

What is claimed is:

1. A fixing device in which a recording material is conveyed by being held by a fixing nip portion, and unfixed toner images on said recording material are melted and fixed, comprising:

a first rotating element of a roller shape;

induction heating means, which is provided with an exciting coil wound along the outer peripheral surface or the inner peripheral surface of said first rotating element and having a clearance changing in the direction of the axis of rotation of said first rotating element, for heating said first rotating element by electromagnetic induction; and a pressing member which is pressed into contact with said first rotating element or a second rotating element heated by said first rotating element and is rotated in the forward direction to form the fixing nip portion.

2. The fixing device according to claim 1, wherein at least a part of clearance of said exciting coil increases from the central portion toward the end portion of said first rotating element.

3. A fixing device in which a recording material is conveyed by being held by a fixing nip portion, and unfixed toner images on said recording material are melted and fixed, comprising:

a first rotating element of a roller shape;

induction heating means, which is provided with an exciting coil wound along the outer peripheral surface or the inner peripheral surface of said first rotating element and having a winding length changing in the direction of the axis of rotation of said first rotating element, for heating said first rotating element by electromagnetic induction; and a pressing member which is pressed into contact with said first rotating element or a second rotating element heated by said first rotating element and is rotated in the forward direction to form the fixing nip portion.

4. The fixing device according to claim 3, wherein at least a part of winding length of said exciting coil increases from the central portion toward the end portion of said first rotating element.

5. A fixing device in which a recording material is conveyed by being held by a fixing nip portion, and unfixed toner images on said recording material are melted and fixed, comprising:

a first rotating element of a roller shape;

induction heating means, which is provided with an exciting coil wound along the outer peripheral surface or the inner peripheral surface of said first rotating element and having a cross-sectional area of core material changing in the direction perpendicular to the axis of rotation of said first rotating element, for heating said first rotating element by electromagnetic induction; and a pressing member which is pressed into contact with said first rotating element or a second rotating element heated by said first rotating element and is rotated in the forward direction to form the fixing nip portion.

6. The fixing device according to claim 5, wherein at least a part of cross-sectional area of the exciting coil increases from the central portion toward the end portion of said first rotating element.

7. The fixing device according to any one of claims 1 to 6, wherein a core material of said exciting coil is formed of a resin member in which magnetic powder is mixed.

8. The fixing device according to any one of claims 1 to 6, wherein a core material of said exciting coil consists of an integrally molded core.

9. The fixing device according to claim 8, wherein a core material of said exciting coil consists of a core formed with a plurality of holes.

10. The fixing device according to claim 8, wherein the hole area of core material of said exciting coil changes in the direction perpendicular to the axis of rotation of said first rotating element.

11. The fixing device according to claim 8, wherein at least a part of hole area of the core material of said exciting coil decreases from the central portion toward the end portion of said first rotating element.

* * * * *